US007336249B2

(12) United States Patent
Hirakata et al.

(10) Patent No.: US 7,336,249 B2
(45) **Date of Patent: *Feb. 26, 2008**

(54) DRIVING METHOD OF ACTIVE MATRIX DISPLAY DEVICE

(75) Inventors: Yoshiharu Hirakata, Kanagawa (JP); Yasuhiko Takemura, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 291 days.

This patent is subject to a terminal disclaimer.

(21) Appl. No.: 11/166,339

(22) Filed: Jun. 27, 2005

(65) Prior Publication Data

US 2006/0017679 A1 Jan. 26, 2006

Related U.S. Application Data

(63) Continuation of application No. 09/206,653, filed on Dec. 7, 1998, now Pat. No. 6,911,962, which is a continuation of application No. 08/823,238, filed on Mar. 24, 1997, now Pat. No. 5,847,687.

(30) Foreign Application Priority Data

Mar. 26, 1996 (JP) ..... 8-096317

(51) Int. Cl.
*G09G 3/36* (2006.01)

(52) U.S. Cl. ..... 345/87; 345/89; 345/90; 345/92; 345/94; 345/96; 345/204; 345/211

(58) Field of Classification Search ..... 345/87, 345/89, 90–96, 204, 208–210, 211–213
See application file for complete search history.

(56) References Cited

U.S. PATENT DOCUMENTS

| | | | |
|---|---|---|---|
| 4,345,249 | A | 8/1982 | Togashi |
| 4,393,380 | A | 7/1983 | Hosokawa et al. |
| 5,093,655 | A | 3/1992 | Tanioka et al. |
| 5,296,847 | A | 3/1994 | Takeda et al. |

(Continued)

FOREIGN PATENT DOCUMENTS

| | | |
|---|---|---|
| EP | 241 562 | 6/1992 |

(Continued)

*Primary Examiner*—Richard Hjerpe
*Assistant Examiner*—Jennifer T Nguyen
(74) *Attorney, Agent, or Firm*—Fish & Richardson P.C.

(57) ABSTRACT

In a liquid crystal display device of the in-plane switching mode (IPS mode), the potential of data that is output from a data driver is set at values between potentials that are given to common lines. Two levels, i.e., high and low levels, are prepared for the potential to be given to the common lines and the potential is inverted between those levels in every field, whereby the polarity of a voltage between both electrodes of a pixel is inverted. As a result, the potential variation ranges of signals that are output from the data driver and a scan driver can be greatly reduced from those of the conventional case, which contributes to reduction in the power consumption of the drivers. Since the voltage applied to a switching element for controlling each pixel can be reduced, the load of the switching element can also be reduced.

40 Claims, 6 Drawing Sheets

U.S. PATENT DOCUMENTS

| | | | | | |
|---|---|---|---|---|---|
| 5,448,384 | A | 9/1995 | Uchino et al. | | |
| 5,526,012 | A | 6/1996 | Shibahara | | |
| 5,537,129 | A | 7/1996 | Okada et al. | | |
| 5,598,285 | A | 1/1997 | Kondo et al. | | |
| 5,737,051 | A | 4/1998 | Kondo et al. | | |
| 5,793,346 | A | 8/1998 | Moon | | |
| 5,847,687 | A * | 12/1998 | Hirakata et al. | 345/96 | |
| 5,867,139 | A | 2/1999 | Tanaka et al. | | |
| 5,903,249 | A | 5/1999 | Koyama et al. | | |
| 5,926,161 | A * | 7/1999 | Furuhashi et al. | 345/100 | |
| 5,926,162 | A | 7/1999 | Wood et al. | | |
| 5,945,970 | A | 8/1999 | Moon et al. | | |
| 5,959,599 | A | 9/1999 | Hirakata | | |
| 5,977,562 | A | 11/1999 | Hirakata et al. | | |
| 6,005,542 | A * | 12/1999 | Yoon | 345/92 | |
| 6,031,514 | A | 2/2000 | Hashimoto et al. | | |
| 6,911,962 | B1 * | 6/2005 | Hirakata et al. | 345/87 | |

FOREIGN PATENT DOCUMENTS

| | | |
|---|---|---|
| EP | 0 558 059 | 9/1993 |
| JP | 62-066476 | 4/1987 |
| JP | 63-21907 | 5/1988 |
| JP | 04-151121 | 5/1992 |
| JP | 05-241124 | 9/1993 |
| JP | 06-160878 | 6/1994 |
| JP | 06-202073 | 7/1994 |
| JP | 06-214244 | 8/1994 |
| JP | 06-295164 | 10/1994 |
| JP | 07-036058 | 2/1995 |
| JP | 07-043716 | 2/1995 |
| JP | 07-043744 | 2/1995 |
| JP | 07-072491 | 3/1995 |
| JP | 07-120791 | 5/1995 |
| JP | 07-134301 | 5/1995 |

* cited by examiner

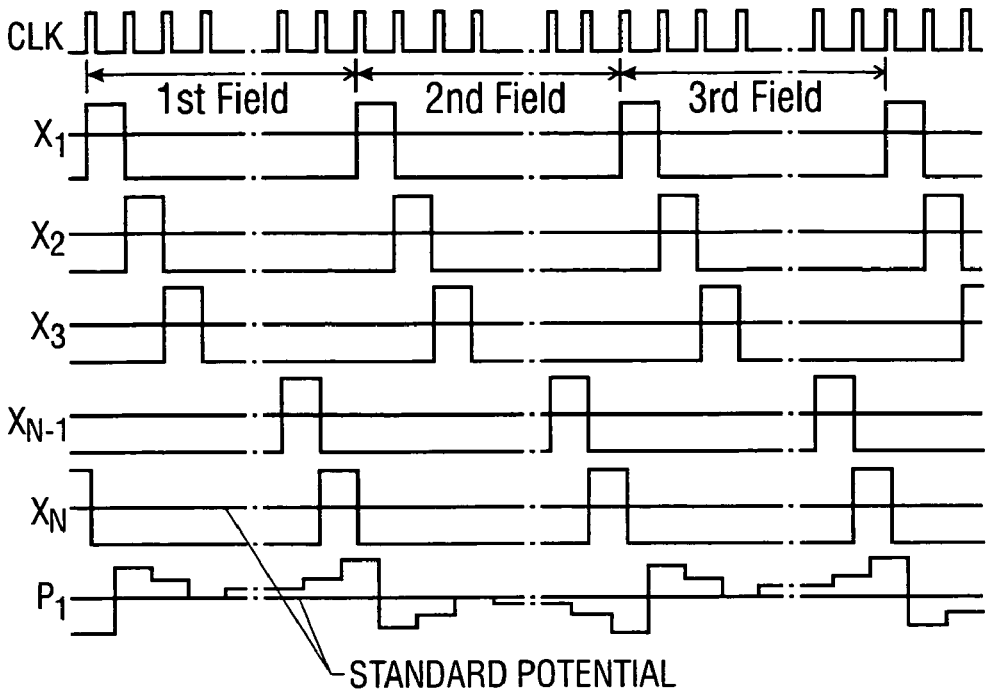
*FIG. 8*
*(Prior Art)*
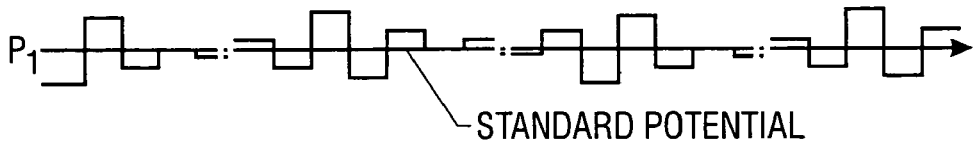
*FIG. 9*
*(Prior Art)*
FIELD (FRAME) INVERSION
| | | | | | | | | | |
|---|---|---|---|---|---|---|---|---|---|
| + | + | + | + | + | + | + | + | + | + |
| + | + | + | + | + | + | + | + | + | + |
| + | + | + | + | + | + | + | + | + | + |
| + | + | + | + | + | + | + | + | + | + |
| + | + | + | + | + | + | + | + | + | + |
| + | + | + | + | + | + | + | + | + | + |
*FIG. 10A*
*(Prior Art)*
GATE LINE INVERSION
| | | | | | | | | | |
|---|---|---|---|---|---|---|---|---|---|
| + | + | + | + | + | + | + | + | + | + |
| − | − | − | − | − | − | − | − | − | − |
| + | + | + | + | + | + | + | + | + | + |
| − | − | − | − | − | − | − | − | − | − |
| + | + | + | + | + | + | + | + | + | + |
| − | − | − | − | − | − | − | − | − | − |
*FIG. 10B*
*(Prior Art)*

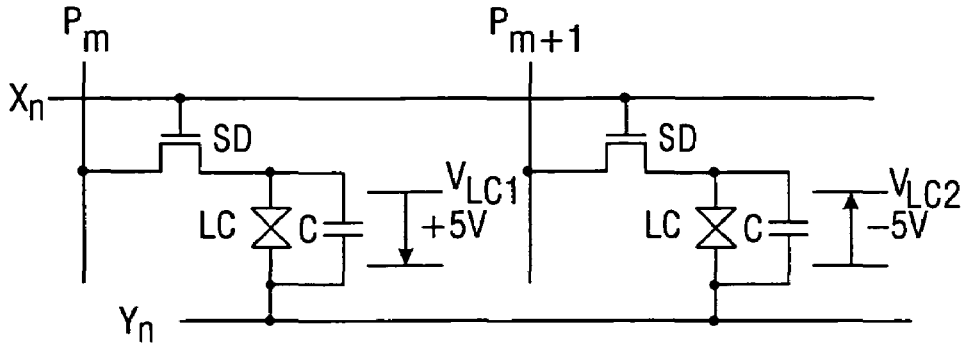
*FIG. 12A*
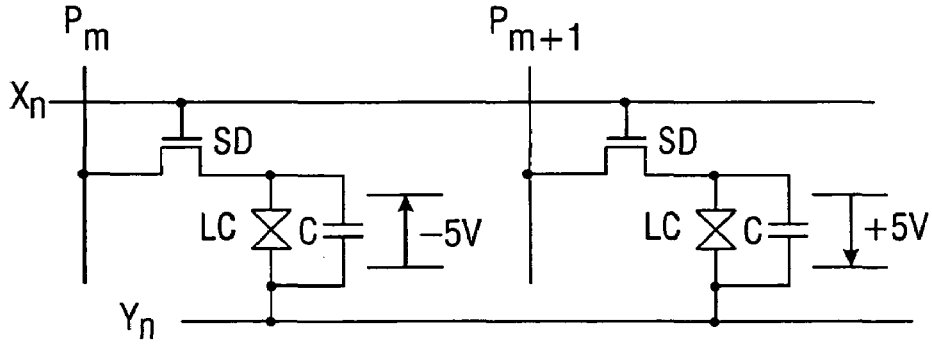
*FIG. 12B*
| | FIRST FIELD | NEXT FIELD |
|---|---|---|
| $P_m$ | +5V | 0V |
| $P_{m+1}$ | −5V | 0V |
| $Y_n$ | 0V | +5V |
| $V_{LC1}$ | +5V | −5V |
| $V_{LC2}$ | −5V | +5V |
$V_{LC1} = P_m - V_n \quad V_{LC2} = P_{m+1} - V_n$
*FIG. 12C*

DRIVING METHOD OF ACTIVE MATRIX DISPLAY DEVICE

CROSS-REFERENCE TO RELATED APPLICATIONS

This application is a continuation application of U.S. application Ser. No. 09/206,653, filed on Dec. 7, 1998 now U.S. Pat. No. 6,911,962, now allowed, which is a continuation of U.S. application Ser. No. 08/823,238, filed on Mar. 24, 1997, now U.S. Pat. No. 5,847,687, which claims the benefit of Japanese foreign priority application Serial No. 08-096317, filed on Mar. 26, 1996. This application claims priority to all of these applications, and all of these applications are incorporated by reference.

BACKGROUND OF THE INVENTION

1. Field of the Invention

The present invention relates to an active matrix display device. In particular, the invention relates to an active matrix display device which employs a display method of the in-plane switching mode (also called IPS mode). The invention is intended to reduce potential variation of signals (or data) to thereby lower the power consumption, and to reduce voltages applied to the switching elements that are provided for the respective pixels to thereby lower the loads of the switching elements. The invention also relates to a driving method of a capacitive-coupling-type display device such as a liquid crystal display device.

2. Description of Related Art

In a capacitive-coupling-type display device such as a liquid crystal display device, it is necessary to invert the polarity of a voltage applied to a pixel capacitor element. This operation is also called alternating. This is because if electric fields in one direction are always applied to an electro-optical material (a material whose optical property such as light transmittance, reflectance, or a refractive index varies depending on the voltage applied thereto) provided between the electrodes of a capacitor element, the material will deteriorate. It is necessary to invert the polarity of the voltage every field (or frame) or every several fields.

Among various inverting methods, there are a field (or frame) inverting scheme in which the polarity is the same over the entire display screen in each field (see FIG. 10A), and a gate line inverting scheme in which the polarity of each row is different from adjacent rows, (see FIG. 10B). The above methods can be applied to the IPS mode.

Conventionally, the polarity inversion is performed such that each pixel is supplied, from a data driver (signal driver), with a signal whose polarity is inverted. FIG. 7 shows a unit pixel of a conventional active matrix liquid crystal display device. A thin-film transistor T as a switching element is controlled by a signal (selection pulses) on a scan line $X_n$. In a state that a selection pulse is applied to the thin-film transistor T (on-state), a signal on a data line (signal line) $P_m$ is supplied to a liquid crystal pixel element LC and, if necessary, to an auxiliary capacitor C connected in parallel with the pixel element. On the other hand, the potential of a common line (or common electrode) $Y_n$ is kept constant. Charge is stored in accordance with a difference between the potential supplied from the data line $P_m$ and that of the common line $Y_n$.

FIG. 8 shows drive signals in a display device in which such unit pixels are arranged in an N-row matrix. In FIG. 8, a clock signal (sync signal) CLK indicates a minimum operation time of the display device. Signals are generated based on the clock signal CLK. As shown in FIG. 8, selection pulses are sequentially applied to scan lines $X_1$, $X_2$, $X_3$, . . . , $X_{N-1}$, $X_N$. On the other hand, potentials depending on image signals for the respective rows are applied to a data line $P_1$. This example is directed to the field inverting scheme (FIG. 10A). For convenience of comparison, it is assumed that the image information of the fields are always the same; that is, the data of the second field is an inversion of that of the first field with respect to the reference potential (i.e., the potential of the common lines). The same relationship exists between the second and third fields.

FIG. 9 shows an example of data in the case of the gate line inverting scheme (FIG. 10B). The data for each row has opposite polarities between the first and second fields.

As described above, in the conventional active matrix liquid crystal display devices, the driver needs to generate data whose variation range is two times that of a signal required by only image information. That is, although basically it is sufficient to apply a liquid crystal with effective voltages of a 5 V, the necessity of inversion requires a variation range of 10 V, i.e., +5 V to −5 V. This increases drive voltages of the driver, and hence is the greatest obstacle to reduction in power consumption.

There is another problem because of the increase of large potential variations of data, output potential differences (i.e., selection pulse heights) of the scan driver, and power consumption therein. Further, due to large voltages applied to the active matrix circuit, the switching elements (transistors) will possibly be broken or their characteristics will possibly deteriorate.

The present invention has been made in view of the above problems, and an object of the invention is therefore to provide a device configuration and a corresponding driving method which enable necessary polarity inversion while minimizing data variations.

In the in-plane switching (IPS) mode, a display is performed by applying electric fields of which directions are parallel with a substrate surface by means of a single substrate, in contrast to the conventional liquid crystal display devices in which display is performed by applying, between the substrates, electric fields perpendicular to the substrates. Japanese Examined Patent Publication No. Sho. 63-21907 discloses the basic concept of the IPS mode in an active matrix liquid crystal display device using thin-film transistors as switching elements.

Among the inventions made by adapting the above basic concept of the IPS mode are disclosed in Japanese Unexamined Patent Publication Nos. Hei. 7-43744, Hei. 7-43716, Hei. 7-36058, Hei. 6-160878, Hei. 6-202073, Hei. 7-134301, and Hei. 6-214244. Further, Japanese Unexamined Patent Publication No. Hei. 7-72491 is directed to a case where the IPS mode is used in a passive matrix liquid crystal display device. Japanese Unexamined Patent Publication No. Hei. 7-120791 is directed to a case where the IPS mode is employed in an active matrix liquid crystal display device using thin-film diodes as switching elements.

The operation principle of the IPS mode disclosed in the above prior art references will be briefly described below with reference to FIGS. 5 and 6. FIG. 5 shows a unit pixel of an active matrix liquid crystal display device using the IPS mode. As in the case of ordinary active matrix liquid crystal display devices, data lines 11 and scan lines 12 are arranged in matrix form. In addition, common lines (also called opposed electrode lines) 13 are provided.

Conventionally, the common lines 13 are not necessary in the substrate because the opposed substrate has them. However, in the IPS mode in which the opposed substrate has no electrode, wiring lines (i.e., common lines 13) having a function equivalent to that of the above electrode need to be provided on the substrate concerned.

In the conventional IPS mode, the potential of the common lines 13 is kept at a constant value. Where the common lines 13 are formed at the same time as the scan lines 12, the former is patterned so as not intersect the latter, that is, so as to be parallel with the latter. With this structure, the common line 13 may be overlapped with a pixel electrode 14 which is formed at the same time as the data line 11, to form an auxiliary electrode C.

That is, the scan lines 12 and the common lines 13 can be formed at the same time and the data lines 11 and the pixel electrodes 14 can also be formed at the same time. A switching element (thin-film transistor, i.e., TFT) is formed as shown in FIG. 5 with a portion of the scan line 12 used as a control electrode (i.e., gate electrode). The input terminal (source) of the switching element is in contact with the data line 11 and the output terminal (drain) is in contact with one electrode (pixel electrode 14) of the pixel capacitor element. The common line 13 serves as the other electrode of the pixel capacitor element.

In FIG. 6, since the common line 13 is so formed as to be opposed to the pixel electrode 14 as described above, when a potential is given to the pixel electrode 14, electric fields indicated by arrows develop between the pixel electrode 14 and the common line 13. Where a liquid crystal is used as the electro-optical material, in the initial state liquid crystal molecules are so oriented as to form a predetermined angle with expected electric fields (state a in FIG. 6). For example, in the case of a nematic liquid crystal, the predetermined angle is 15°. When electric fields are applied, liquid crystal molecules tend to become parallel with the electric field (state b in FIG. 6). Gradation can be expressed by properly utilizing the inclination of liquid crystal molecules. The description of the operation principle of the IPS mode concludes here.

The IPS mode has a feature of a wider viewing angle than in the conventional liquid crystal display devices because the liquid crystal is oriented parallel with the substrates. However, in the above-described prior art of the IPS mode, no consideration is made of reduction in the load of the data driver; data are generated in the same manner as in the conventional cases.

SUMMARY OF THE INVENTION

According to the present invention, with keeping the feature of the IPS mode, it is able to reduce the potential variation range of data while inverting the direction of electric fields applied to liquid crystal molecules. The invention is directed to a configuration in which the common lines and the scan lines are arranged so as not to cross each other and the potential of each common line can be controlled in accordance with a signal supplied to the corresponding scan line. The invention is characterized in that each common line is given a potential $V_H$ or $V_L$ ($V_H > V_L$) during almost all of a period when a selection pulse is not applied to the corresponding scan line, and that each pixel electrode is given a signal potential $V_D$ ($V_L \leqq V_D \leqq V_H$) in accordance with image information.

Naturally, a potential other than $V_H$ and $V_L$ (for instance, a middle value thereof or a value larger than the middle value) may be given to the common lines in a very short period (short enough not to affect an image; for instance, immediately before or after application of a selection pulse).

To avoid affecting an image, the period during which a potential other than $V_H$ and $V_L$ is applied should be shorter than 20% of one field period, preferably shorter than 5% thereof. That is, the common lines should be kept at the potential $V_H$ or $V_L$ during 80% or more of one field period, preferably 95% or more thereof.

In the invention, in a case where inversion is performed every field, the potential of each common line in a certain field may be set different from that of immediately preceding and following fields.

Since the potential of each common line needs to be kept constant until another signal is input next via the switching element, it may be changed to another value every time a pulse signal is applied to the corresponding scan line.

The invention can be applied to both of the field inverting scheme and the gate line inverting scheme. In the latter case, the potentials of adjacent common lines may be set always different from each other.

Where the invention is applied to a liquid crystal display device, it is preferred that the potential given to each common line be lower than the threshold voltage of a liquid crystal, to avoid affecting an image.

When the voltage applied to a liquid crystal is increased from 0 V, the major axes of liquid crystal molecules are rotated at a time point when the voltage exceeds a certain value. This voltage value is called the threshold voltage of the liquid crystal.

Therefore, even if the potentials of the common lines vary, disorder in the alignment of the liquid crystal, and resulting influences on an image are prevented by making the absolute values of the potentials given to the common lines smaller than the threshold voltage of the liquid crystal.

BRIEF DESCRIPTION OF THE DRAWINGS

FIG. 8 shows the operation of a conventional active matrix liquid crystal display device (field inverting mode);

FIG. 9 shows the operation of a conventional active matrix liquid crystal display device (gate line inverting mode);

FIGS. 10A and 10B illustrate the concepts of field (or frame) inversion and gate line inversion, respectively;

FIG. 12A-12C show why it is not effective to apply the invention to the source line inverting scheme.

DETAILED DESCRIPTION OF THE PREFERRED EMBODIMENTS

Figure 5:
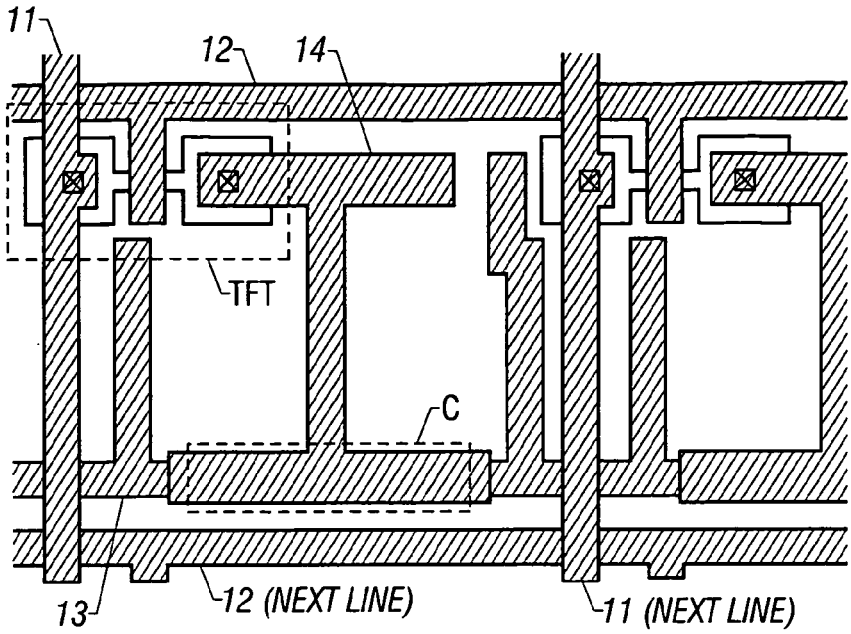
FIG. 5 (Prior Art)
FIG. 5 shows a unit pixel in the IPS mode.
Figure 6:
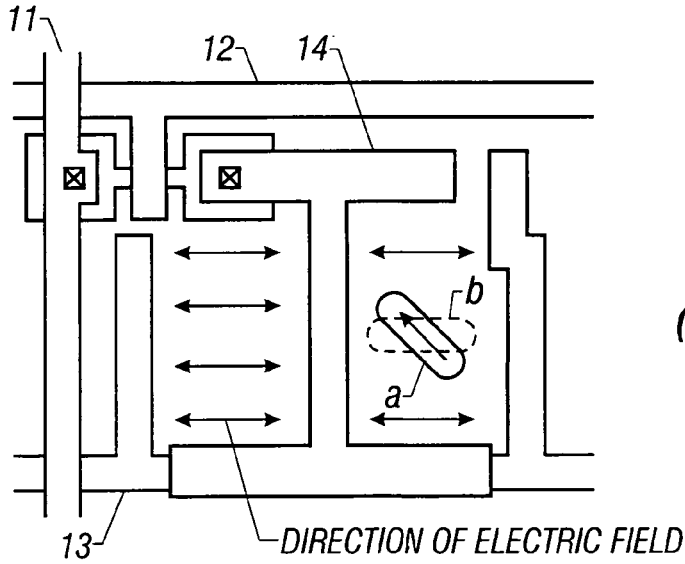
FIG. 6 (Prior Art)
FIG. 6 shows the operation principle of the IPS mode.

The operation of a unit pixel according to the present invention will be described below with reference to FIGS. 3A and 3B. A specific electrode/wiring line structure corresponding to FIGS. 3A and 3B is the same as that of the conventional active matrix display device of the IPS mode shown in FIG. 5.

Figure 3A:
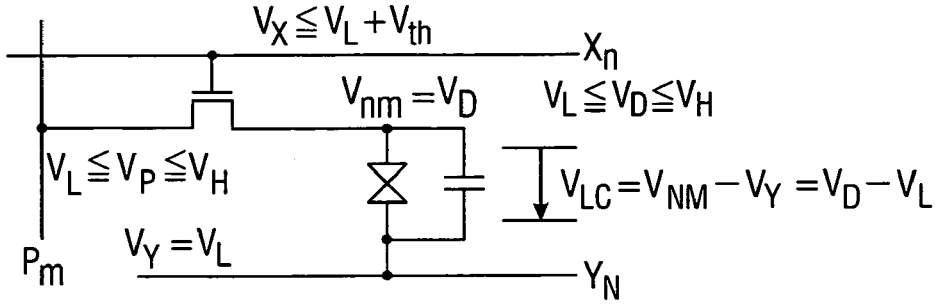
FIGS. 3A and 3B show the operation principle of the invention for a unit pixel.
Figure 3B:
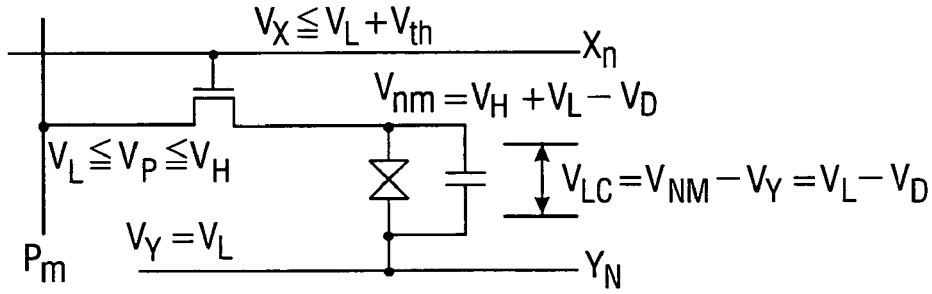

Both FIGS. 3A and 3B show a state that the switching element SD is closed. Therefore, in either case, the scan line $X_n$ is supplied with a potential for rendering the switching element SD in an off-state. Where the switching element SD is a single, n-channel transistor, the necessary and sufficient condition of such a potential $V_X$ is $V_X \leqq V_L + V_{th}$ ($V_{th}$ is the threshold voltage of the switching element SD) for the reason described later.

In a certain field, a pixel electrode potential $V_{nm}$ is equal to $V_D$, which corresponds to image information and satisfies a condition $V_L \leqq V_D \leqq V_H$ in any case. It goes without saying that the pixel electrode potential $V_{nm}$ is determined by a potential $V_P$ of the data lines $P_m$ at a time point when the switching element SD is opened (more precisely, at an instant when it is closed). Therefore, $V_L \leqq V_P \leqq V_H$.

In FIG. 3A, a potential $V_Y$ of the common line $Y_n$ is $V_L$. In this state, a potential difference $V_{LC}$ ($=V_{nm}-V_Y$) applied to the pixel capacitor element LC is $V_D-V_L$. Since $V_D \geqq V_L$, the direction of an actual electric field is as indicated by the arrow.

It is assumed that in the next field the potential difference across the pixel capacitor element LC is reversed (FIG. 3B). In this field, the potential $V_Y$ of the common line $Y_n$ is set at $V_H$, and the pixel electrode potential $V_{nm}$ is set at $V_H+V_L-V_D$. From the condition $V_L \leqq V_D \leqq V_H$, an inequality $V_L \leqq V_H+V_L-V_D \leqq V_H$ is satisfied. The potential difference $V_{LC}$ ($=V_{nm}-V_Y$) applied to the pixel capacitor element LC is equal to $V_L-V_D$. Since $V_D \geqq V_L$, the direction of an actual electric field is as indicated by the arrow in FIG. 3B. Thus, the electric field direction can be reversed.

From the equations of $V_{LC}$ in the above two fields, the following inequalities hold:

(First field): $V_{LC}=V_D-V_L \leqq V_H-V_L$ (Next field): $V_{LC}=V_L-V_D \geqq V_L-V_H$ Therefore, there is the following relationship:

$V_L-V_H \leqq V_{LC} \leqq V_H-V_L$, or $|V_{LC}| \leqq V_H-V_L$

That is, the magnitude of the voltage difference across the pixel capacitor element LC is $V_H-V_L$ or less. Incidentally, the above relationship is not satisfied in the conventional method because the potential of the common line $Y_n$ does not vary, that is, $V_H=V_L=0$ and $|V_{LC}|>0$. The fact that the potential $V_Y$ of the common electrode $Y_n$ varies so as to have the above relationship satisfied is one of the features of the invention.

Next, the potential of the data line $P_m$ will be considered. To obtain the state of FIG. 3B, the potential $V_P$ of the data line $P_m$ needs to be set such that $V_P=V_{nm}=V_H+V_L-V_D$. Since $V_L \leqq V_H+V_L-V_D \leqq V_H$, the relationship $V_L \leqq V_P \leqq V_H$ is satisfied also in this case. That is, when the polarity inversion is performed, the potential $V_P$ of the data line $P_m$ satisfies $V_L \leqq V_P \leqq V_H$.

Where the switching element SD is a single, n-channel transistor, to keep an off-state irrespective of the potentials of the data line and the pixel electrode, the potential $V_X$ of the scan line (gate line) may be set lower than a potential that is the total of the threshold voltage and the lower one of the potentials of the data line and the pixel electrode. Since the minimum value that can be taken by the potentials of the data line and the pixel electrode is $V_L$, it is sufficient that the potential $V_X$ of the scan line be so set as to satisfy $V_X \leqq V_L + V_{th}$.

On the other hand, to obtain an on-state, the potential $V_X$ of the scan line may be set higher than a potential that is the total of the threshold voltage and the higher one of the potentials of the data line and the pixel electrode. Since the maximum value that can be taken by the potentials of the data line and the pixel electrode is $V_H$, it is sufficient that the potential $V_X$ of the scan line be so set as to satisfy $V_X \geqq V_H + V_{th}$.

For example, where the maximum voltage difference applied to the pixel capacitor element LC is 5 V, $V_L$ and $V_H$ may be set at 0 V and +5 V, respectively, in which case the data line potential $V_P$ satisfies $0 \leqq V_P \leqq 5$ V. In this manner, the voltage difference applied to the pixel capacitor element LC can have any value between −5 V and +5 V. On the other hand, it is sufficient that the scan line potential $V_X$ be lower than $V_{th}$ V in an on-state and higher than $(5+V_{th})$ V in an on-state. For example, with assumptions that the threshold voltage $V_{th}$ is +0.5 V and a margin of 1.5 V is established, the scan line potential $V_X$ may be set at 7 V in an on-state and −1 V in an off-state.

As described above, the invention has another feature that even if the variation range of data applied to the data line (and the common line) is greatly reduced from that of the conventional case, the direction of an electric field applied to the liquid crystal capacitor element LC can still be reversed.

For example, it is able to make the potential variation range of data in half. The fact that the variation range of the potential given to the scan line (i.e., the selection pulse height) can be greatly reduced too, which is another feature of the invention. In this manner, the invention can reduce the operation voltages to a large extent.

Although the invention is effective for inverting schemes such as the field inversion and the gate line inversion in which the pixels associated with the same scan line have the same polarity, the above-described advantages cannot be obtained in inverting schemes such as the source line inversion and the dot inversion in which the pixels associated with the same scan line have different polarities.

The source line inverting scheme is characterized in that adjacent pixel electrodes of the same row (i.e., the same scan line) have different polarities. For example, as shown in FIGS. 12A-12C, assume a case where potential differences VLC1 and $V_{LC2}$ of two adjacent (i.e., left and right) pixels are +5 V and −5 V in the first field (FIG. 12A) and −5 V and +5 V in the second field (FIG. 12B).

Where the switching element SD is an n-channel transistor, the scan line potential is required to be lower than the minimum potential of the data line in an off-state and to be higher than the maximum potential of the data line in an on-state. In the conventional methods (see FIGS. 8 and 9), the potentials of both data lines $P_m$ and $P_{m+1}$ varies between −5 V and +5 V, i.e, over a range of 10 V. Therefore, the potential variation range of the scan line should also be 10 V.

To apply the invention to the left-side pixel, in the first field the potential of the common line $Y_n$ and the data of the data line $P_m$ may be set at 0 V and +5 V, respectively, and in the second field they may be set at +5 V and 0 V, respectively. As for the right-hand pixel, the data of the data line $P_{m+1}$ may be set at −5 V in the first field and 0 V in the second field. FIG. 12C summarizes the above.

To effect switching under the above conditions with the assumption that the switching element is an n-channel transistor SD, the potential of the scan line $X_n$ should be lower than −5 V (minimum potential of the data line) in an off-state and should be higher than +5 V (maximum potential of the data line) in an on-state. That is, the variation range of 10 V is still required; the invention is the same as the conventional cases in terms of the potential variation range of the scan line (i.e., the driving ability of the scan driver). The invention provides no advantage in this respect.

However, the potential variation range of each data line is 5 V, which is a half of that of the conventional cases. Thus, the invention cannot substantially reduce the voltages of the entire display circuit, but it is effective in reducing the potential variation range of each data line. Naturally, the effect of the source line inverting is less than that of the field inverting or the gate lane inverting.

Incidentally, in the invention, the common line cannot be formed in parallel with the data line because in such a case a signal on the common line would vary in accordance with the potential of the data line.

Embodiment 1

Figure 1:
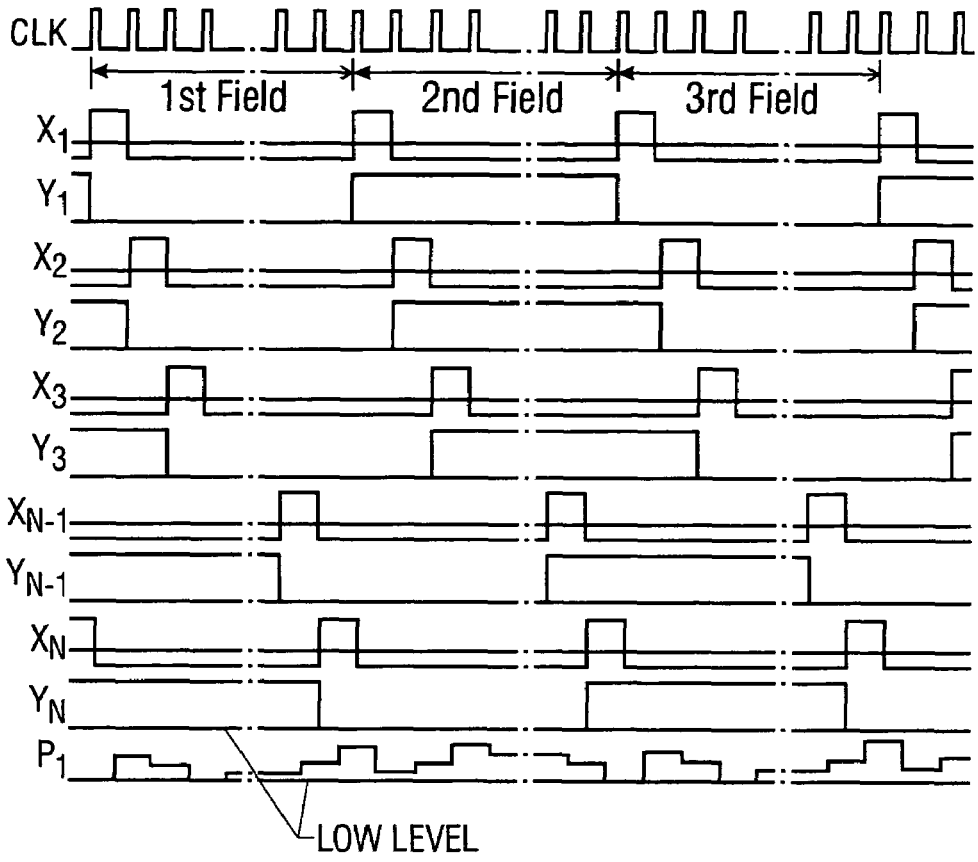
FIG. 1 shows a field inverting type driving method according to a first embodiment of the present invention.

FIG. 1 shows a field inverting type driving method according to the invention in an N-row active matrix liquid crystal display device employing the IPS mode. In this embodiment, the same display data as shown in FIG. 8 are used. As shown in FIG. 1, in the first field, selection pulses are sequentially applied to N scan lines $X_1, X_2, X_3, \ldots, X_{N-1}, X_N$. At a time point when a pulse is applied to each scan line, the potential of the corresponding one of the common lines $Y_1, Y_2, Y_3, \ldots, Y_{N-1}, Y_N$ decreases from the high-level ($V_H$) to the low-level ($V_L$). Thus, the state of FIG. 3A is realized.

Conversely, in the second field, when selection pulses are sequentially applied to the scan lines $X_1, X_2, X_3, \ldots, X_{N-1}, X_N$, the potentials of the corresponding common lines $Y_1, Y_2, Y_3, \ldots, Y_{N-1}, Y_N$ increase from the low-level to the high-level. This the state of FIG. 3B is realized.

In the third field, the same operation as in the first field is performed. The direction of an electric field applied to each liquid crystal capacitor element in the first field is in inverse to that in the second field. The same relationship holds between the second field and the third field. In this embodiment, the state of FIG. 3A or 3B is established in all rows in a certain field. Thus, the field inverting type driving is performed.

Embodiment 2

Figure 2:
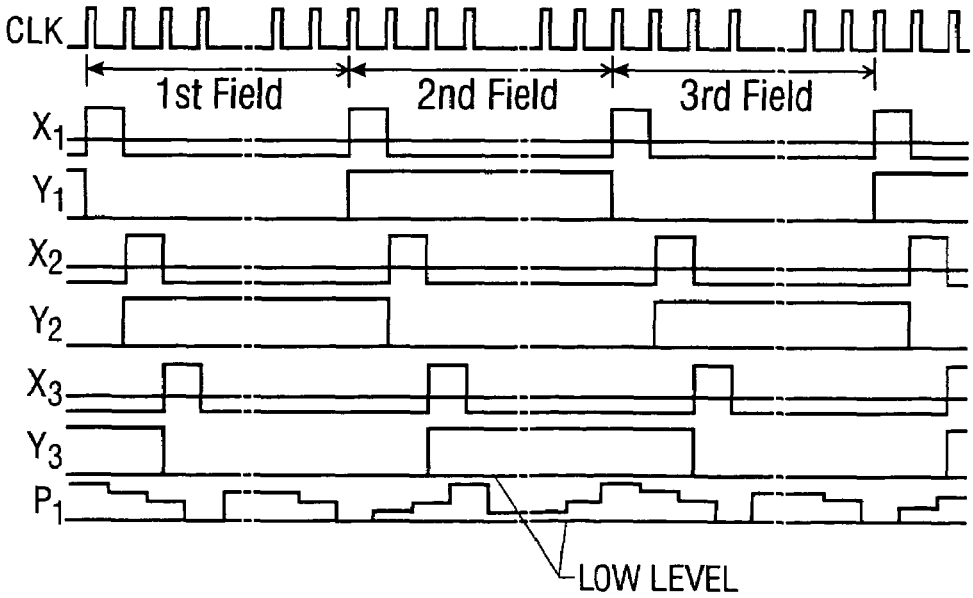
FIG. 2 shows a gate line inverting type driving method according to a second embodiment of the invention.

FIG. 2 shows a gate line inverting type driving method according to the invention in an N-row active matrix liquid crystal display device employing the IPS mode. As shown in FIG. 2, in the first field, the potentials of the odd-numbered common lines $Y_1, Y_3, \ldots$ are changed from the high-level to the low-level when selection pulses are applied to the corresponding scan lines. Conversely, the potentials of the even-numbered common lines $Y_2, Y_4, \ldots$ are changed from the low-level to the high-level when selection pulses are applied to the corresponding scan lines.

That is, in the first field, the state of FIG. 3A is established in the odd-numbered rows and the state of FIG. 3B is established in the even-numbered rows. Thus, a gate line inverting state is attained in which the directions of electric fields applied to the liquid crystal capacitor elements LC in adjacent rows are reverse to each other.

The operation in the second field is in converse to that in the first field. The potentials of the odd-numbered common lines $Y_1, Y_3, \ldots$ are changed from the low-level to the high-level while the potentials of the even-numbered common lines $Y_2, Y_4, \ldots$ are changed from the high-level to the low-level. That is, in the second field, the state of FIG. 3B is established in the odd-numbered rows and the state of FIG. 3A is established in the even-numbered rows. The operation in the third field is the same as in the first field.

When attention is paid to a particular row, it is seen that the direction of an electric field applied to the liquid crystal capacitor element LC in the first field is in inverse to that in the second field. In this embodiment, the direction of electric fields applied to the liquid crystal capacitor elements LC of the even-numbered rows is in inverse to that of the odd-numbered rows; that is, the line inverting type driving is performed.

Figure 4:
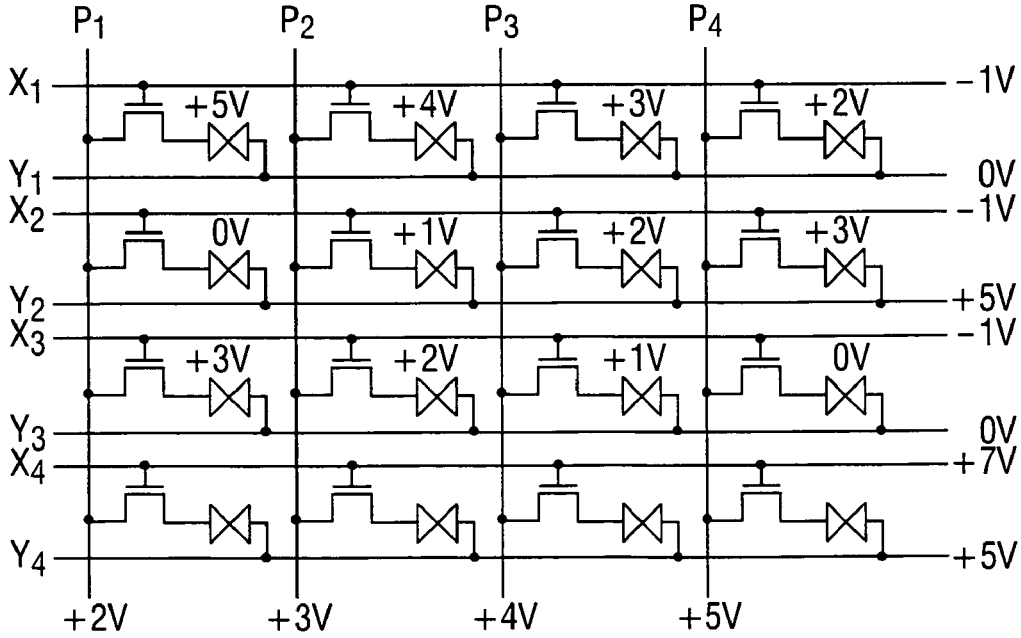
FIG. 4 shows potentials of part of the matrix in a certain field in the second embodiment of the invention.

FIG. 4 shows potentials of part of the matrix in a certain field. In FIG. 4, values shown in the matrix represent potentials of the associated pixel electrodes. As for the potentials of the common lines, $V_L$=0 V and $V_H$ is +5 V. The scan lines are given a potential of −1 V in an off-state and +7 V in an on-state.

In FIG. 4, the pixels of the fourth row are being subjected to writing. Although the first and second rows display exactly the same image information, the directions of electric fields are in inverse in those rows. For example, with attention paid to the first-row/second column unit pixel and the second-row/second-column unit pixel, in the former unit pixel the potential of the pixel electrode is higher than that of the common line with a potential difference of +4 V, whereas the latter unit pixel has a potential difference of −4 V. A similar relationship holds between other pairs of electrodes. In the fourth row under writing, the potentials of the data lines $P_1$-$P_4$ are so set that the same image information as has been written to the third row is written to the fourth row (the directions of electric fields are in inverse).

Embodiment 3

Figure 7:
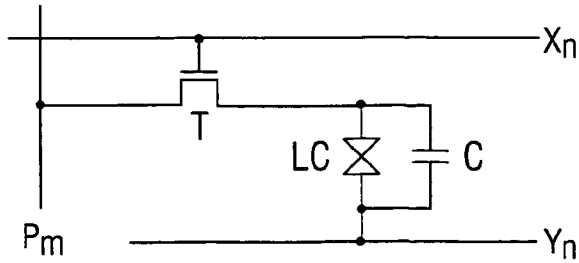
FIG. 7 (Prior Art)
FIG. 7 shows the configuration of a unit pixel of an active matrix liquid crystal display device.
Figure 11A:
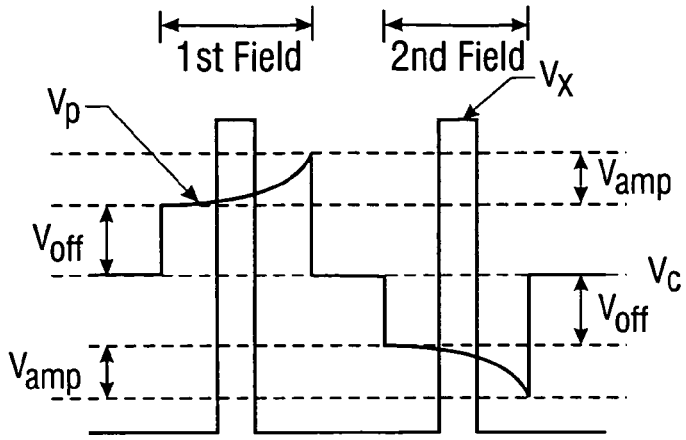
FIG. 11A (Prior Art)
FIGS. 11A-11C shows differences between a conventional driving method and a driving method according to a third embodiment of the invention.
Figure 11B:
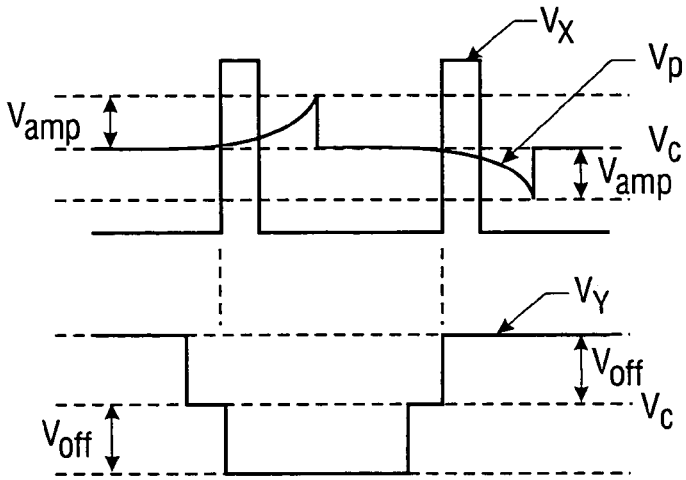
Figure 11C:
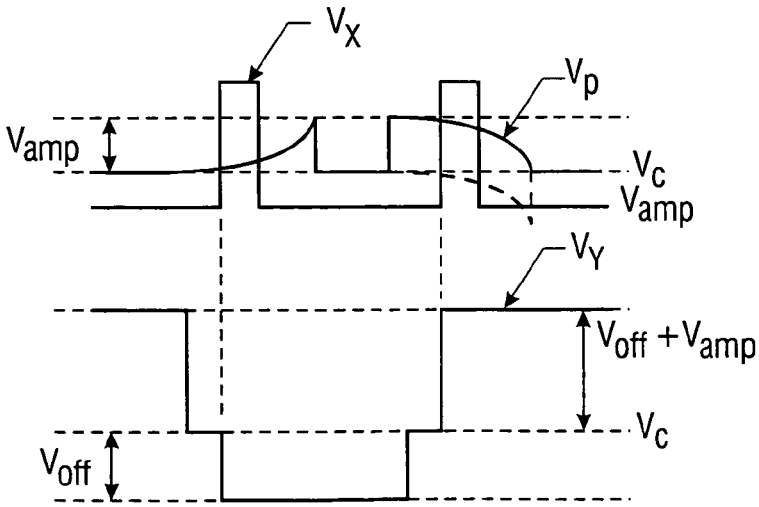

Differences between the driving method of the invention and the conventional driving method will be described below with reference FIGS. 11A-11C. FIGS. 11A-11C show waveforms of the potentials of the scan line $X_n$, the data line $P_m$, and the common line $Y_n$ that are connected to the pixel shown in FIG. 7. It is assumed that the field inverting scheme is employed. This embodiment employs a scheme in which an offset voltage $V_{off}$ is always superimposed on the voltage that is applied to the pixel. In FIGS. 11A-11C, the potential $V_X$ applied to the scan line $X_n$ and the potential $V_P$ of the data line $P_m$ are expressed with overlapping on each other, the potential $V_Y$ of the common line $V_n$ is drawn separately with $V_C$ used as a reference potential when it varies over time (FIGS. 11B and 11C), to prevent the drawings from becoming unduly complex.

FIG. 11A shows the conventional driving method. The potential $V_Y$ of the common line (or common electrode) $Y_n$ is kept at the constant value $V_C$. The potential variation due to the image information itself is only $V_{amp}$. However, due to the offset voltage $V_{off}$, the potential $V_P$ of the data line $P_m$ has the maximum variation of $2(V_{amp}+V_{off})$. Accordingly, the height of selection pulses on the scan line $X_n$ increases.

However, as a matter of fact, useless voltages are applied to the data line $P_m$. One of those voltages is the offset voltage $V_{off}$. The offset voltage $V_{off}$ need not be supplied via the data line $P_m$. The potential variation of the data line $P_m$ can be reduced by supplying the offset voltage $V_{off}$ via the common line $Y_n$. FIG. 11B shows such a case.

What we should pay attention to is the potential difference applied to "the pixel in an off-state" rather than the potential difference between "the data line $P_m$ and the common line $Y_n$." Therefore, the offset voltage $V_{off}$ is supplied to the common line $Y_n$ in synchronism with the application of a selection pulse to the scan line $X_n$. In the example of FIG. 11B, the potential of the common line $Y_n$ is changed to $V_C$ immediately before the application of a selection pulse. The voltage based on only the image information is applied to the data line $P_m$.

In the above manner, the potential variation of the data line $P_m$ can be reduced to $2V_{amp}$ and the selection pulse height can be reduced accordingly. It is apparent that the voltage applied to the pixel in an off-state is almost the same as in the conventional case.

However, even in the driving method of FIG. 11B, a useless voltage is still applied to the data line $P_m$, which is an inverted output for the alternating. To eliminate the inverting output, in the second field the data is given a bias of $V_{amp}$ with respect to the data shown in FIG. 11B (also indicated by a broken line in FIG. 11C; this data is based on only the image information). With this measure, the potential variation of the data line $P_m$ is reduced to $V_{amp}$.

Since the potential $V_P$ of the data line $P_m$ is biased by $V_{amp}$ in the second field, the potential $V_Y$ of the common line $Y_n$ should also be increased by $V_{amp}$ in the second field. If this is not the case, the polarity inversion is not effected properly. FIG. 11C is an example in which the potential variation of the data line $P_m$ is decreased according to the above-described concept.

As described above, the potential variation of the data line $P_m$ can be reduced to $V_{amp}$ and the selection pulse height can be reduced accordingly. It is apparent that the voltage applied to the pixel in a non-selection state is exactly the same as in the case of FIG. 11B and almost the same as in the conventional case of FIG. 11A.

For example, if $V_{off}$ and $V_{amp}$ are respectively set at 2 V and 3 V and the selection pulse height is so set as to have a 2-V margin with respect to each of the minimum and maximum values of the potential $V_P$ of the data line $P_m$, the potential variation range of the data line $P_m$ is 10 V and the selection pulse height is 14 V in the conventional driving method of FIG. 11A.

On the other hand, the potential variation range of the data line $P_m$ is 6 V and the selection pulse height is 10 V in the case of FIG. 11B. In the case of FIG. 11C, the potential variation range of the data line $P_m$ and the selection pulse height can be reduced to 3 V and 7 V, respectively.

As described above, the invention can make the potential variation of data in half while enabling the directions of electric fields applied to liquid crystal capacitor elements to be inverted. As a result, the drive voltages of the data driver can be made a half of those in the conventional case, which is effective in reducing the power consumption. Further, the employment of the invention is advantageous also in the driving circuit of the scan driver and the transistors used in the active matrix circuit.

For example, in an active matrix circuit (see FIG. 7) employing the conventional driving method, if the potential of the electrode of the opposed substrate (or common lines) is set at a constant value, for instance, 0 V, and the variation range of the data for image display is 0 to 5 V, the potential of data that is output from the data driver varies from +5 V to −5 V (variation range: 10 V). That is, the source-drain potential difference of the transistors amounts to 10 V at the maximum.

To keep the transistors in an off-state during non-selection periods in a stable manner even under the above condition, the gate electrode potential of the transistors needs to be lower than $-5+V_{th}$ V (for NMOS transistors; higher than $5-V_{th}$ V for PMOS transistors). (The following description will be directed only to the case of NMOS transistors.)

Further, to keep the transistors in an on-state during selection periods in a reliable manner, the gate electrode potential of the transistors needs to be higher than $+5+V_{th}$ V.

In the above description of the embodiments, it is assumed that the threshold voltage $V_{th}$ is +0.5 V and the margin is 1.5 V. Under the same conditions, the potentials to keep an off-state and an on-state should be −6 V and +7 V, respectively. In this case, the maximum source-drain potential difference and the maximum gate-source (or gate-drain) potential difference of the switching transistors amount to 10 V and 12 V, respectively. It is understood that an unduly heavy load as compared to the voltage (5 V) required from image information is imposed on the switching transistors. For this reason, high-breakdown-voltage transistors need to be used in the active matrix circuit.

The scan driver is also required to produce voltages ranging from −6 V to +7 V, i.e., having a potential difference (selection pulse height) of 13 V, which is unduly large. Further, the output potential difference of the data driver is 10 V.

In contrast, according to the invention, even if the same transistors are used to perform the same display as in the above case, the potential variation of data is from 0 V to 5 V (potential difference: 5 V) and the potential of the data line can be kept of the same polarity, as described in the above embodiments. Further, to keep the transistors in an off-state during non-selection periods in a stable manner, the gate electrode potential of the transistors may be set at about −1 V. To keep the transistors in an on-state during selection periods in a reliable manner, the gate electrode potential may be set at about +7 V. That is, the output potential difference (selection pulse height) of the scan driver is 8 V.

That is, according to the invention, the switching transistors of the active matrix circuit have the maximum source-drain potential difference of 5 V and the maximum gate-source (or gate-drain) potential difference of 7 V, for instance. The latter value is much smaller than the potential difference 12 V of the conventional case. Although the 5 V-decrease in potential difference may not appear to provide remarkable effects, it can sufficiently reduce the load of the transistors; that is, it is very effective in increasing the yield of transistors.

Experiments of the present inventors have proved that where a 1,200-Å-thick silicon oxide film is used as the gate-insulating film, a very small number of transistors are broken when, the gate-source voltage is smaller than 10 V, whereas once the gate-source voltage exceeds 10 V the number of broken transistors increases exponentially with every 1 V-increment. Thus, to make the gate-source voltage smaller than 10 V is very meaningful from the industrial viewpoint.

As described above, the invention enables the driving in which the potential of data varies from 0 V to 5 V, which means that the potential variation range is 5 V and the potential of the data line has a single polarity.

As a result, the invention allows the data driver to produce signals of a single polarity, in contrast to the fact that conventionally the data driver needs to supply polarity-inverting signals to the data lines to effect alternating.

Further, according to the invention, the height of selection pulses that are output from the scan driver is 8 V, which is smaller than the conventional value of 13 V. This means reduction in the load of the scan driver.

Thus, the invention can reduce the power consumption not only in the data driver but also in the scan driver, and can also reduce the load of the transistors used in the active matrix circuit. In particular, as long as the latter item is concerned, even transistors of a little low in quality are allowed to operate with sufficient performance.

The fact that the output voltages of the scan driver and the data driver can be reduced means that the load of the transistors used therein can also be reduced. This is particularly effective in what is called a monolithic active matrix circuit in which the scan driver and the data driver are incorporated in the same substrate as the active matrix circuit in an integral manner. This is because in a monolithic active matrix circuit thin-film transistors are generally used in the scan driver and the data driver as in the active matrix circuit and the thin-film transistors have a weakness of a low breakdown voltage.

Further, the reduction in selection pulse height leads to a reduction in the pixel-side voltage drop that is caused at the time of switching by the existence of a parasitic capacitor of the switching transistor (what is called a feedthrough voltage). This is because this voltage drop is proportional to the selection pulse height.

Although the above embodiments are directed to the case where n-channel transistors (NMOS transistors) are used, it goes without saying that the driving can be performed in the same manner even with p-channel transistors (PMOS transistors). Further, although the above embodiments are directed to the case of in-plane switching (IPS) mode, the present invention is not limited for the IPS device. Exhibiting various advantages when applied to active matrix liquid crystal display devices as described above, the invention is very useful from the industrial viewpoint.

What is claimed is:

1. A method for driving an active matrix display device comprising:

applying a potential $V_p$ to a data line $P_m$ for a pixel electrode;

applying a potential $V_H$ to a common line $Y_n$; and changing said potential $V_H$ for said common line $Y_n$ to a potential $V_L$ before or at the same time when a first selection pulse $V_x$ for a first field is applied to a scan line $X_n$ corresponding to said data line $P_m$ and said common line $Y_n$, wherein each of said potentials $V_H$ and $V_L$ applied to said common line $Y_n$ is different from a standard voltage Vc, and wherein said potential $V_p$ to said data line $P_m$ satisfies a condition $V_L \leqq V_p \leqq V_H$.

2. A method according to claim 1, wherein said active matrix display device is operated by a field inverting mode.

3. A method according to claim 1, wherein said common line $Y_n$ is kept at said potential $V_H$ or $V_L$ during 80% or more of one field period.

4. A method according to claim 1, wherein said common line $Y_n$ is kept at said potential $V_H$ or $V_L$ during 95% or more of one field period.

5. A method according to claim 1, wherein both of said potentials $V_H$ and $V_L$ are lower than a threshold voltage of a liquid crystal material included in said active matrix display device.

6. A method according to claim 1, wherein said data line, scan line, common line and pixel electrode are formed over a substrate.

7. A method according to claim 1, wherein said potential $V_p$ to said data line $P_m$ produces signals of a single polarity.

8. A method for driving an active matrix display device comprising:

applying a potential $V_p$ to a data line $P_m$ fox a pixel electrode;

applying a potential $V_H$ to a common line $Y_n$;

changing said potential $V_H$ for said common line $Y_n$ to a standard voltage $V_c$ before a first selection pulse $V_X$ for a first field is applied to a scan line $X_n$ corresponding to said data line $P_m$ and said common line $Y_n$; and changing said potential Vc for said common line $Y_n$ to a potential $V_L$ at the same time when the first selection pulse $V_X$ to said scan line $X_n$, wherein said potential $V_p$ to said data line $P_m$ satisfies a condition $V_L \leqq V_p \leqq V_H$.

9. A method according to claim 8, wherein said potentials $V_H$, $V_C$, and $V_L$ satisfy an inequality, $V_H > V_C > V_L$.

10. A method according to claim 8, wherein said active matrix display device is operated by a field inverting mode.

11. A method according to claim 8, wherein said common line $Y_n$ is kept at said potential $V_H$ or $V_L$ during 80% or more of one field period.

12. A method according to claim 8, wherein said common line $Y_n$ is kept at said potential $V_H$ or $V_L$ during 95% or more of one field period.

13. A method according to claim 8, wherein both of said potentials $V_H$ and $V_L$ are lower than a threshold voltage of a liquid crystal material included in said active matrix display device.

14. A method according to claim 8, wherein said data line, scan fine, common line and pixel electrode are formed over a substrate.

15. A method according to claim 8, wherein said potential $V_p$ to said data line $P_m$ produces signals of a single polarity.

16. A method for driving an active matrix display device comprising a pixel portion having a plurality of scan lines, a plurality of data lines, a plurality of common lines, a plurality of switching elements for switching pixel electrodes over a substrate, said method comprising:

applying a potential $V_p$ to a data line $P_m$ for a pixel electrode;

applying a potential $V_Y$ to a common line $Y_n$; and inverting said potential $V_Y$ for said common line $Y_n$ before or at the same time when a first selection pulse $V_X$ for a fist field is applied to a scan line $X_n$ corresponding to said data line $P_m$ and said common line $Y_n$, wherein a value of said potential $V_Y$ for said common line $Y_n$ equals a potential ($V_{offset}+V_{amp}$) or $V_{offset}$, wherein said $V_{amp}$ is a potential of an image information, and wherein said potential $V_p$ to said data line $P_m$ satisfies a condition $V_L \leqq V_p \leqq V_H$.

17. A method according to claim 16, wherein said active matrix display device is operated by a field inverting mode.

18. A method according to claim 16, wherein said common line $Y_n$ is kept at said potential ($V_{offset}+V_{amp}$) or −;$V_{offset}$ to be superimposed on said potential $V_p$ during 80% or more of one field period.

19. A method according to claim 16, wherein said common line $Y_n$ is kept at said potential ($V_{offset}+V_{amp}$) or −; $V_{offset}$ to be superimposed on said potential $V_p$ during 95% or more of one field period.

20. A method according to claim 16, wherein said potential $V_Y$ for said common line $Y_n$ is lower than a threshold voltage of a liquid crystal material included in said active matrix display device.

21. A method according to claim 16, wherein said potential $V_p$ to said data line $P_m$ produces signals of a single polarity.

22. A method for driving an active matrix display device comprising:

applying a potential $V_p$ to a data line $P_m$ connected to a source of a pixel thin film transistor over a substrate;

applying a potential $V_H$ to a common line $Y_n$ over said substrate; and changing said potential $V_H$ of said common line $Y_n$ to a potential $V_L$ before or at the same time when a first selection pulse $V_X$ for a first field is applied to a scan line $X_n$ connected to a gate of said pixel Thin film transistor, wherein each of said potentials $V_H$ and $V_L$ applied to said common line $Y_n$ is different from a standard voltage Vc, and wherein said potential $V_p$ to said data line $P_m$ satisfies a condition $V_L \leqq V_p \leqq V_H$.

23. A method according to claim 22, wherein said active matrix display device is operated by a field inverting mode.

24. A method according to claim 22, wherein said common line $Y_n$ is kept at said potential $V_H$ or $V_L$ during 80% or more of one field period.

25. A method according to claim 22, wherein said common line $Y_n$ is kept at said potential $V_H$ or $V_L$ during 95% or more of one field period.

26. A method according to claim 22, wherein both of said potentials $V_H$ and $V_L$ are lower than a threshold voltage of a liquid crystal material included in said active matrix display device.

27. A method according to claim 22, wherein said potential $V_p$ to said data line $P_m$ produces signals of a single polarity.

28. A method for driving an active matrix display device comprising:

applying a potential $V_p$ to a data line $P_m$ connected to a source of a pixel thin film transistor over a substrate;

applying a potential $V_H$ to a common line $Y_n$ over said substrate;

changing said potential $V_H$ of said common line $Y_n$ to a standard voltage $V_c$ before a first selection pulse $V_X$ for a first field is applied to a scan line $X_n$ connected to a gate of said pixel thin film transistor; and changing said potential Vc of said common line $Y_n$ to a potential $V_L$ at the same time when the first selection pulse $V_X$ to said scan line $X_n$, wherein said potential $V_p$ to said data line $P_m$ satisfies a condition $V_L \leqq V_p \leqq V_H$.

29. A method according to claim 28, wherein said potentials $V_H$, $V_C$, and $V_L$ satisfy art inequality, $V_H > V_C > V_L$.

30. A method according to claim 28, wherein said active matrix display device is operated by a field inverting mode.

31. A method according to claim 28, wherein said common line $Y_n$ is kept at said potential $V_H$ or $V_L$ during 80% or more of one field period.

32. A method according to claim 28, wherein said common line $Y_n$ is kept at said potential $V_H$ or $V_L$ during 95% or more of one field period.

33. A method according to claim 28, wherein both of said potentials $V_H$ and $V_L$ are lower than a threshold voltage of a liquid crystal material included in said active matrix display device.

34. A method according to claim 28, wherein said potential $V_p$ to said data line $P_m$ produces signals of a single polarity.

35. A method for driving an active matrix display device comprising the steps of:

applying a potential $V_p$ to a data line $P_m$ for a pixel electrode;

applying a potential $V_Y$ to a common line $Y_n$; and changing said potential $V_Y$ for said common line $Y_n$ to a potential $V_H$ or $V_L$ before or at the same time when a first selection pulse $V_X$ for a first field is applied to a scan line $X_n$ corresponding to said data line $P_m$ and said common line $Y_n$, wherein said $V_H$ and $V_L$ are maximum and minimum potentials given to said common lines, respectively, wherein said potential $V_p$ to said data line $P_m$ satisfies a condition $V_L \leqq V_p \leqq V_H$.

36. A method according to claim 35, wherein said active matrix display device is operated by a field inverting mode.

37. A method according to claim 35, wherein said common line $Y_n$ is kept at said potential $V_H$ or $V_L$ during 80% or more of one field period.

38. A method according to claim 35, wherein said common line $Y_n$ is kept at said potential $V_H$ or $V_L$ during 95% or more of one field period.

39. A method according to claim 35, wherein said potential $V_Y$ for said common line $Y_n$ is lower than a threshold voltage of a liquid crystal material included in said active matrix display device.

40. A method according to claim 35, wherein said potential $V_p$ to said data line $P_m$ produces signals of a single polarity.

* * * * *